US012774504B2

(12) United States Patent
Han et al.

(10) Patent No.: US 12,774,504 B2
(45) Date of Patent: Oct. 27, 2026

(54) HIGH-STRENGTH COLD ROLLED STEEL SHEET WITH LOW MATERIAL NON-UNIFORMITY AND EXCELLENT FORMABILITY, HOT DIPPED GALVANIZED STEEL SHEET, AND MANUFACTURING METHOD THEREFOR

(71) Applicant: POSCO, Pohang-si (KR)

(72) Inventors: Seong-Ho Han, Gwangyang-si (KR); Sang-Ho Han, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 473 days.

(21) Appl. No.: 17/339,619

(22) Filed: Jun. 4, 2021

(65) Prior Publication Data

US 2021/0292862 A1 Sep. 23, 2021

Related U.S. Application Data

(62) Division of application No. 15/537,743, filed as application No. PCT/KR2015/004597 on May 8, 2015, now abandoned.

(30) Foreign Application Priority Data

Dec. 19, 2014 (KR) ..... 10-2014-0184935
May 7, 2015 (KR) ..... 10-2015-0064050

(51) Int. Cl.
*C21D 9/46* (2006.01)
*C21D 8/02* (2006.01)
(Continued)

(52) U.S. Cl.
CPC ..... *C21D 8/0236* (2013.01); *C21D 8/02* (2013.01); *C21D 8/0226* (2013.01);
(Continued)

(58) Field of Classification Search
CPC ..... C21D 9/46; C21D 9/48; C21D 2211/005; C21D 2211/008
See application file for complete search history.

(56) References Cited

U.S. PATENT DOCUMENTS 6,537,394 B1 3/2003 Osawa
9,534,279 B2 1/2017 Masuda et al.
(Continued)

FOREIGN PATENT DOCUMENTS

CN 101326299 A 12/2008
CN 102021482 A 4/2011
(Continued)

OTHER PUBLICATIONS

Thome, Ralf and Klaus Harste, "Principles of Billet Soft-reduction and Consequences for Continuous Casting," ISIJ International, vol. 46 (2006), No. 12, pp. 1839-1844. (Year: 2006).*
(Continued)

*Primary Examiner* — Vanessa T. Luk
(74) *Attorney, Agent, or Firm* — Morgan Lewis & Bockius LLP

(57) ABSTRACT

A high-strength cold-rolled steel sheet and a hot-dipped galvanized steel sheet with low deviation of material properties and excellent formability, and a method for manufacturing same are provided. The present invention relates to a low-yield-ratio high-strength cold-rolled steel sheet with low deviation of directional material and excellent formability, comprising 0.05-0.15 wt % of C, 0.2-1.5 wt % of Si, 2.2-3.0 wt % of Mn, 0.001-0.10 wt % of P, 0.010 wt % or less of S, 0.01-0.10 wt % of sol.Al, 0.010 wt % or less of N, and the balance of Fe and impurities, satisfying Si/(Mn+Si) ≤0.5, wherein the microstructure of the steel sheet includes 40% or more of ferrite, 10% or less of bainite, 3% or less of residual austenite, and a balance of martensite, and the area
(Continued)

fraction of a Mn band present in the martensite phase is 5% or less.

7 Claims, 4 Drawing Sheets

(51) Int. Cl.

| | |
|---|---|
| ***C21D 8/0221*** | (2026.01) |
| ***C21D 8/0247*** | (2026.01) |
| ***C21D 8/04*** | (2026.01) |
| ***C22C 38/02*** | (2006.01) |
| ***C22C 38/04*** | (2006.01) |
| ***C22C 38/06*** | (2006.01) |
| ***C22C 38/38*** | (2006.01) |
| ***C22C 38/60*** | (2006.01) |
| ***C23C 2/40*** | (2006.01) |

(52) U.S. Cl.
CPC ..... *C21D 8/0273* (2013.01); *C21D 8/0436* (2013.01); *C21D 8/0473* (2013.01); *C21D 9/46* (2013.01); *C22C 38/02* (2013.01); *C22C 38/04* (2013.01); *C22C 38/06* (2013.01); *C22C 38/38* (2013.01); *C22C 38/60* (2013.01); *C23C 2/40* (2013.01); *C21D 2211/005* (2013.01); *C21D 2211/008* (2013.01)

(56) References Cited

U.S. PATENT DOCUMENTS

| | | | | |
|---|---|---|---|---|
| 2004/0238082 | A1* | 12/2004 | Hasegawa | C22C 38/06 148/652 |
| 2010/0296960 | A1* | 11/2010 | Yim | B22D 11/20 164/476 |
| 2011/0017363 | A1* | 1/2011 | Kang | C22C 38/38 148/330 |
| 2013/0092295 | A1* | 4/2013 | Yokoi | C21D 8/0263 148/504 |
| 2013/0213534 | A1* | 8/2013 | Hikita | C21D 8/005 420/104 |
| 2014/0193667 | A1 | 7/2014 | Shuto et al. | |
| 2014/0342184 | A1 | 11/2014 | Taagi et al. | |
| 2015/0361519 | A1 | 12/2015 | Zhu | |

FOREIGN PATENT DOCUMENTS

| | | | | |
|---|---|---|---|---|
| CN | 103732775 | A | 4/2014 | |
| JP | H09-013147 | A | 1/1997 | |
| JP | H11-279691 | A | 10/1999 | |
| JP | 2002-069574 | A | 3/2002 | |
| JP | 2010-156032 | A | 7/2010 | |
| JP | 2011-032549 | A | 2/2011 | |
| JP | 2013-124399 | A | 6/2013 | |
| JP | 2013-163827 | A | 8/2013 | |
| JP | 2014217856 | A * | 11/2014 | B22D 11/12 |
| KR | 10-0711468 | B1 | 4/2007 | |
| KR | 10-1049844 | B1 * | 7/2011 | B22D 11/128 |
| KR | 10-2011-0119285 | A | 11/2011 | |
| KR | 10-2014-0027526 | A | 3/2014 | |
| KR | 10-2014-0099544 | A | 8/2014 | |
| WO | 2007/067014 | A1 | 6/2007 | |
| WO | 2014/114041 | A1 | 7/2014 | |

OTHER PUBLICATIONS

Chinese Office Action dated Mar. 19, 2018 issued in Chinese Patent Application No. 201580069626.0.
U.S. Office Action dated Mar. 30, 2021 issued in U.S. Appl. No. 15/537,743.
"Glossary of Metallurgical and Metalworking Terms," Metals Handbook, ASM Handbooks Online, ASM International, 2002, pp. 1, 76, 206, 226, 232, 233, 257.
U.S. Office Action dated Mar. 13, 2020 issued in U.S. Appl. No. 15/537,743.
U.S. Office Action dated Sep. 5, 2019 issued in U.S. Appl. No. 15/537,743.
M.P. Groover, "Fundamentals of Modern Manufacturing 2/e," John Wiley & Sons, 2002, 64 slides.
U.S. Office Action dated Mar. 8, 2019 issued in U.S. Appl. No. 15/537,743.
International Search Report dated Sep. 8, 2015 issued in International Patent Application No. PCT/KR2015/004597 (with English translation).

* cited by examiner

【Fig. 1】
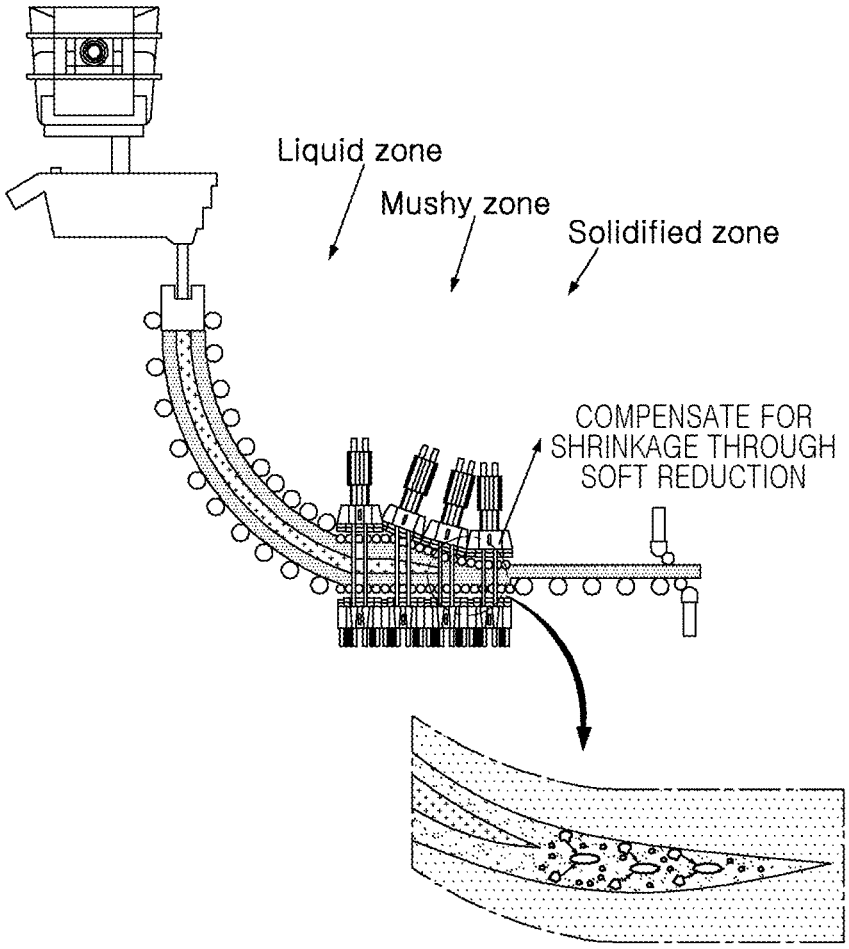

【Fig. 2】
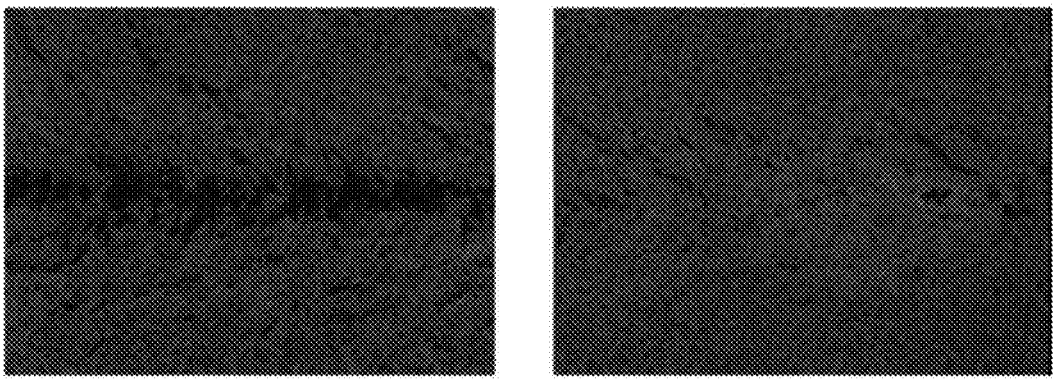
(a) SOFT REDUCTION NOT APPLIED (b) SOFT REDUCTION APPLIED
【Fig. 3】
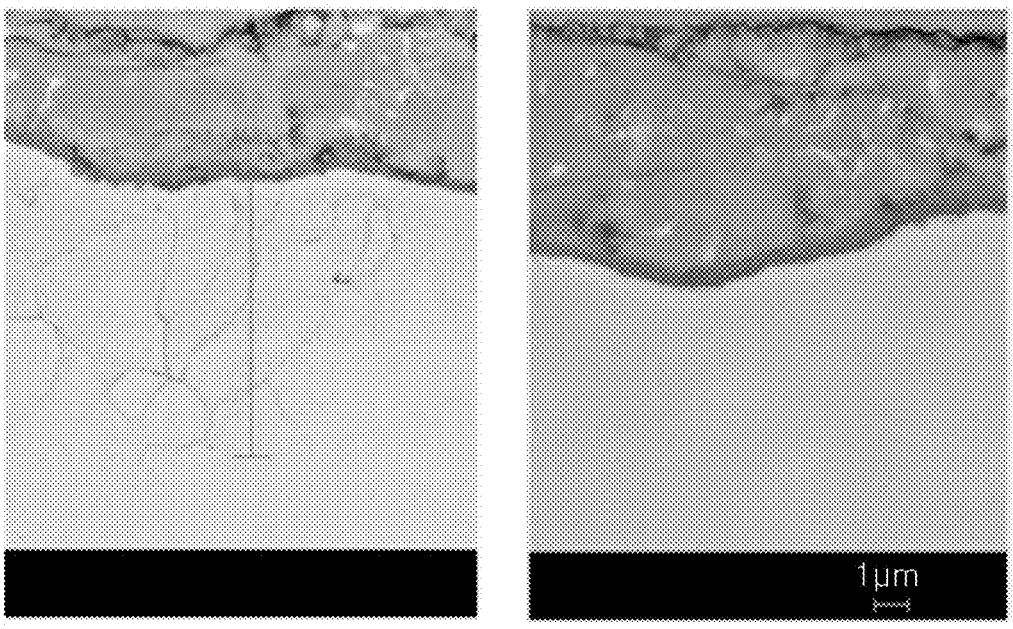
(a) Si/(Si+Mn)>0.5 (b) Si/(Si+Mn)<0.5

【Fig. 4】
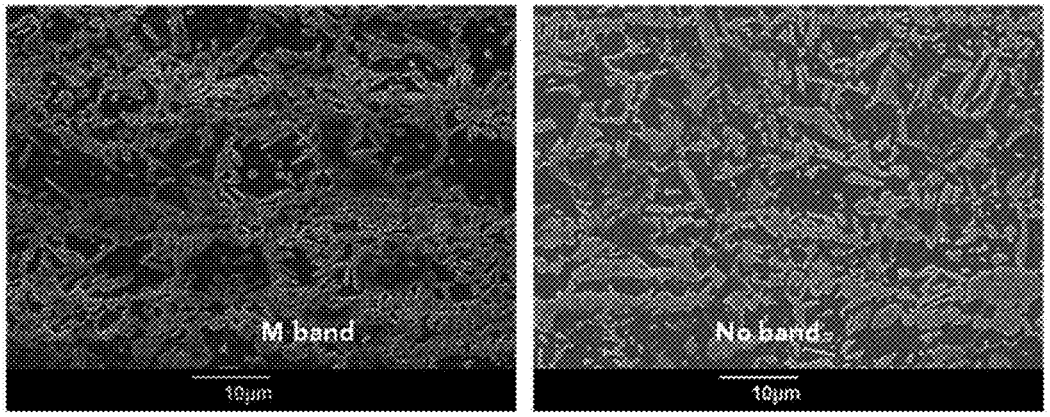
(a) SOFT REDUCTION NOT APPLIED (b) SOFT REDUCTION APPLIED

【Fig. 5】
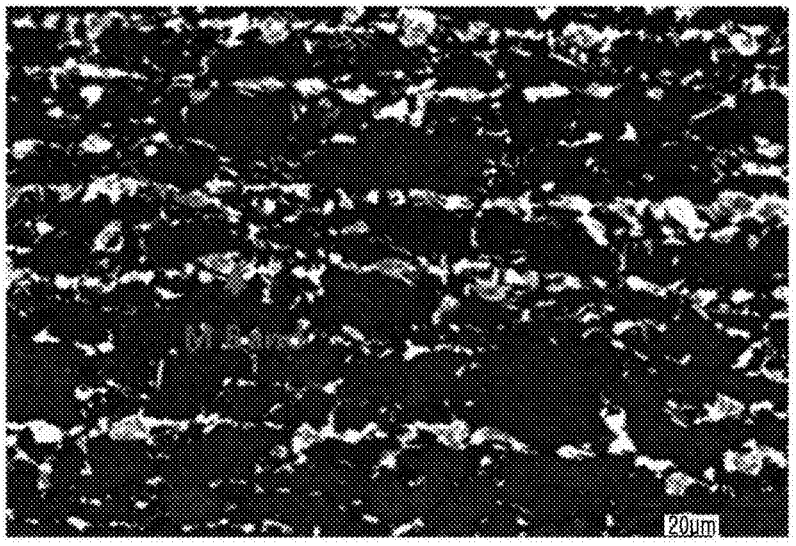
(a) SOFT REDUCTION NOT APPLIED
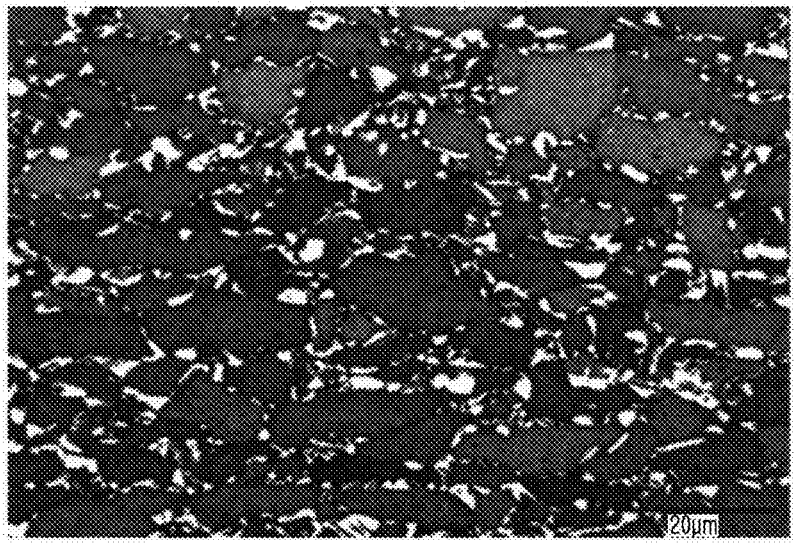
(b) SOFT REDUCTION APPLIED

HIGH-STRENGTH COLD ROLLED STEEL SHEET WITH LOW MATERIAL NON-UNIFORMITY AND EXCELLENT FORMABILITY, HOT DIPPED GALVANIZED STEEL SHEET, AND MANUFACTURING METHOD THEREFOR

CROSS-REFERENCE OF RELATED APPLICATIONS

This application is a Continuation Application of U.S. patent application Ser. No. 15/537,743, filed on Jun. 19, 2017, which is the U.S. National Phase under 35 U.S.C. § 371 of International Patent Application No. PCT/KR2015/004597, filed on May 8, 2015, which in turn claims the benefit of Korean Application Nos. 10-2014-0184935, filed on Dec. 19, 2014 and 10-2015-0064050, filed on May 7, 2015, the entire disclosures of which applications are incorporated by reference herein.

TECHNICAL FIELD

The present disclosure relates to the manufacturing of high-strength steel or a hot-dipped galvanized steel sheet mostly suitable for automobile structural members and, more specifically, to a high-strength cold-rolled steel sheet and hot-dipped galvanized steel sheet having a tensile strength of 780 MPa or higher, a low deviation of material properties and excellent formability, and a method for manufacturing the same.

BACKGROUND ART

As a means of preserving the global environment, fuel economy regulations have been strengthened, and reductions of the weights of car bodies are actively taking place. One countermeasure is to achieve high strength in steel sheets to promote a reduction in the weight of automotive materials.

In general, high-strength automotive materials are divided into precipitation-hardened steel, bake-hardened steel, solid solution-hardened steel, and transformation-hardened steel. Transformation-hardened steel includes dual phase (DP) steel, complex phase (CP) steel, or transformation induced plasticity (TRIP) steel. These types of transformation-hardened steel are also referred to as advanced high strength steel (AHSS). The DP steel contains fine hard martensite uniformly dispersed in soft ferrite to ensure high strength. The CP steel includes two or three phases of ferrite, martensite, and bainite, and contains precipitation-hardening elements such as Ti and Nb to increase strength. The TRIP steel ensures high strength and high ductility by transformation into martensite caused by processing fine retained austenite uniformly dispersed into the TRIP steel at room temperature.

Recently, the application of high-strength steel sheets, having a reduced thickness and a tensile strength (TS) of 780 MPa or higher, to automotive structural members is actively taking place to ensure the safety of passengers in collisions or to reduce fuel expenses through the lightening of car bodies. In particular, the application of high-strength steel sheets having a high TS of 980 or 1,180 MPa level is recently being considered.

However, increasing the strength of steel sheets generally causes a reduction in molding properties, hole expandability, or bendability thereof, involving degradation of formability. Thus, it is preferably demanded a technology for manufacturing an excellent hot-dipped galvanized steel sheet capable of ensuring corrosion resistance in addition to high strength and excellent formability.

In line with such demand, Japanese Patent Laid-open Publication No. Hei. 9-13147, for example, discloses a high-strength hot-dipped galvannealed steel sheet having a TS of 800 MPa or higher, excellent formability and plating adhesion, which includes, by wt %, 0.04 to 0.1% of C, 0.4 to 2.0% of Si, 1.5 to 3.0% of Mn, 0.0005 to 0.005% of B, 0.1% or less of P, greater than 4N and 0.05% or less of Ti, 0.1% or less of Nb, and a balance of Fe and inevitable impurities, and which has a hot-dipped galvannealed layer on a surface layer thereof, includes Fe in the hot-dipped galvannealed layer in an amount of 5 to 25%, and has a mixed microstructure of ferrite and martensite.

Further, Japanese Patent Laid-open Publication No. Hei. 11-279691 discloses a high-strength hot-dipped galvannealed steel sheet having good formability, which includes, by wt %, 0.05 to 0.15% of C, 0.3 to 1.5% of Si, 1.5 to 2.8% of Mn, 0.03% or less of P, 0.02% or less of S, 0.005 to 0.5% of Al, 0.0060% or less of N, and the balance of Fe and inevitable impurities, satisfies a condition of (Mn %)/(C %)≥15 or (Si %)/(C %)≥4, and includes, by volume ratio, 3 to 20% of martensite and retained austenite in ferrite.

Further, Japanese Patent Laid-open Publication No. 2002-69574 discloses a low-yield-ratio and high-strength cold-rolled steel sheet having excellent hole expandability, which includes, by wt %, 0.04 to 0.14% of C, 0.4 to 2.2% of Si, 1.2 to 2.4% of Mn, 0.02% or less of P, 0.01% or less of S, 0.002 to 0.5% of Al, 0.005 to 0.1% of Ti, 0.006% or less of N, and the balance of Fe and inevitable impurities, satisfies a condition of (Ti %)/(S %)≥5, has 6% or more of the sum of volume ratios of martensite and retained austenite and, when a volume ratio of a soft phase microstructure of martensite, retained austenite, and bainite is a %, satisfies a condition of a 50000×{(Ti %)/48+(Nb %)/93+(Mo %)/96+(V %)/51}.

However, technologies regarding the high-strength steel sheets disclosed in Patent Documents 1 to 3 have a problem in that deviations in the material properties of the steel sheet are significantly high.

DISCLOSURE

Technical Problem

An aspect of the present disclosure may provide a low-yield-ratio high-strength cold-rolled steel sheet and hot-dipped galvanized steel sheet having excellent formability, as well as significantly low deviation of material properties, in which a difference between tensile strength and yield strength in a direction perpendicular to a rolling direction and in the rolling direction may be 50 MPa or lower, respectively, in the manufacturing of steel having a tensile strength of 780 MPa or higher in order to solve the above related art problems.

An aspect of the present disclosure may provide a method for manufacturing the low-yield-ratio high-strength cold-rolled steel sheet and hot-dipped galvanized steel sheet.

However, aspects of the present disclosure are not limited thereto. Additional aspects will be set forth in part in the description which follows, and will be apparent from the description to those of ordinary skill in the related art.

Technical Solution

According to an aspect of the present disclosure, a low-yield-ratio high-strength cold-rolled steel sheet with low deviation of directional material and excellent formability, the cold-rolled steel sheet may include: by wt %, 0.05 to 0.15% of C, 0.2 to 1.5% of Si, 2.2 to 3.0% of Mn, 0.001 to 0.10% of P, 0.010% or less of S, 0.01 to 0.10% of sol.Al, 0.010% or less of N, and a balance of Fe and impurities, satisfying a condition of Si/(Mn+Si)≤0.5, in which the cold-rolled steel sheet may have a microstructure including 40% or more of ferrite, 10% or less of bainite, 3% or less of retained austenite, and a balance of martensite, and the fraction of a Mn band present within the martensite may be 5% or less.

Each of tensile strength TS(tr.)−TS(lo.) and yield strength YS(tr.)−YS(lo.) may be 50 MPa or lower, respectively, where tr may refer to a direction perpendicular to a rolling direction and lo may refer to the rolling direction.

The cold-rolled steel sheet may further include at least one of Ti or Nb in an amount of 0.05% or less.

The cold-rolled steel sheet may further include at least one of 0.1 to 0.7% of Cr or 0.1% or less of Mo.

The cold-rolled steel sheet may further include 0.0060% or less of B.

The cold-rolled steel sheet may further include 0.5% or less of Sb.

A hot-dipped galvanized layer may be formed on a surface of the cold-rolled steel sheet.

A hot-dipped galvannealed layer may be formed on a surface of the cold-rolled steel sheet.

According to an aspect of the present disclosure, a method for manufacturing a low-yield-ratio high-strength hot-dipped galvanized steel sheet with low deviation of directional material and excellent formability may include: manufacturing a steel slab using soft reduction and reheating the steel slab at the time of continuously casting steel using molten steel having the above-mentioned composition; finish hot rolling the reheated steel slab at a temperature range of Ar3 to Ar3+50° C., and coiling the hot-rolled steel sheet at a temperature range of 600 to 750° C.; cold rolling the coiled steel sheet at a cold reduction ratio of 40 to 70%, and then continuously annealing the cold-rolled steel sheet at a temperature range of Ac1+30° C. to Ac3−30° C.; and primarily cooling the continuously annealed steel sheet to a temperature range of 650 to 700° C., and then secondarily cooling the primarily cooled steel sheet to a temperature range of Ms−50° C. or lower.

According to an aspect of the present disclosure, a method for manufacturing a low-yield-ratio high-strength hot-dipped galvanized steel sheet with low deviation of directional material and excellent formability may include: manufacturing a steel slab using soft reduction and reheating the steel slab at the time of continuously casting steel using molten steel the above-mentioned composition; finish hot rolling the reheated steel slab at a temperature range of Ar3 to Ar3+50° C., and coiling the hot-rolled steel sheet at a temperature range of 600 to 750° C.; cold rolling the coiled steel sheet at a cold reduction ratio of 40 to 70%, and then continuously annealing the cold-rolled steel sheet at a temperature range of Ac1+30° C. to Ac3−30° C.; and primarily cooling the continuously annealed steel sheet to a temperature range of 650 to 700° C., and then secondarily cooling the primarily cooled steel sheet to a temperature range of 600° C. or lower at an average cooling rate of 3 to 30° C./s; and annealing the cooled steel sheet under normal conditions, and then galvanizing the annealed steel sheet.

According to an aspect of the present disclosure, a method for manufacturing a low-yield-ratio high-strength hot-dipped galvannealed steel sheet with low deviation of directional material and excellent formability may further include galvannealing the manufactured hot-dipped galvanized steel sheet at a temperature range of 450 to 600° C., after the above-mentioned galvanizing.

According to an exemplary embodiment in the present disclosure, the cold-rolled steel sheet, the hot-dipped galvanized steel sheet, or the hot-dipped galvannealed steel sheet may have a microstructure including 40% or more of ferrite, 10% or less of bainite, 3% or less of retained austenite, and a balance of martensite, and may have 5% or less of the fraction of a Mn band present within the martensite.

According to an exemplary embodiment in the present disclosure, the cold-rolled steel sheet, the hot-dipped galvanized steel sheet, or the hot-dipped galvannealed steel sheet may have TS(tr.)−TS(lo.) and YS(tr.)−YS(lo.) of 50 MPa or lower, respectively, where tr may refer to a direction perpendicular to a rolling direction and lo may refer to the rolling direction.

According to an exemplary embodiment in the present disclosure, the cold-rolled steel sheet, the cold-rolled steel sheet, the hot-dipped galvanized steel sheet, or the hot-dipped galvannealed steel sheet may further include at least one of Ti or Nb in an amount of 0.05% or less.

According to an exemplary embodiment in the present disclosure, the cold-rolled steel sheet, the cold-rolled steel sheet, the hot-dipped galvanized steel sheet, or the hot-dipped galvannealed steel sheet may further include at least one of 0.1 to 0.7% of Cr or 0.1% or less of Mo.

According to an exemplary embodiment in the present disclosure, the cold-rolled steel sheet, the cold-rolled steel sheet, the hot-dipped galvanized steel sheet, or the hot-dipped galvannealed steel sheet may further include 0.0060% or less of B.

According to an exemplary embodiment in the present disclosure, the cold-rolled steel sheet, the cold-rolled steel sheet, the hot-dipped galvanized steel sheet, or the hot-dipped galvannealed steel sheet may further include 0.5% or less of Sb.

According to an exemplary embodiment in the present disclosure, the secondarily cooled steel sheet may be subjected to skin-pass rolling at a reduction ratio of 0.2 to 1.0%.

Advantageous Effects

An exemplary embodiment in the present disclosure, having a configuration as described above, may effectively provide a low-yield-ratio high-strength cold-rolled steel sheet, hot-dipped galvanized steel sheet, and hot-dipped galvannealed steel sheet with low deviation of directional material and a tensile strength of 780 MPa or higher, while having a yield ratio of 0.75 or less, a bendability (R/t) of 0.5 or less, a hole expandability of 30% or more, an elongation of 15% or more, as well as a difference between tensile strength and yield strength by direction of 50 MPa or lower.

DESCRIPTION OF DRAWINGS

FIG. 1 is a schematic diagram illustrating the principles of soft reduction in a continuous casting process according to an exemplary embodiment in the present disclosure;

FIG. 2 is an image illustrating a microstructure of a center portion of continuously cast steel according to the presence or absence of soft reduction;

FIG. 3 is an image illustrating an internal microstructure of a hot-rolled steel sheet according to a difference between Si/(Si+Mn) ratios according to an exemplary embodiment in the present disclosure;

FIG. 4 is an image illustrating an internal microstructure of cold-rolled, annealed steel according to the presence or absence of soft reduction according to an exemplary embodiment in the present disclosure; and FIG. 5 is an image illustrating an internal microstructure of cold-rolled, annealed steel according to the presence or absence of soft reduction according to another exemplary embodiment in the present disclosure.

BEST MODE FOR INVENTION

Hereinafter, exemplary embodiments in the present disclosure will be described.

An important feature, proposed in an exemplary embodiment in the present disclosure, is to control deviation of directional material of a steel sheet to be low. Here, the deviation of directional material may refer to a difference between tensile strength (TS) and yield strength (YS) in a direction perpendicular to a rolling direction and in the rolling direction, and the difference may be restricted to 50 MPa or lower. In automotive steel sheets, material anisotropy at the time of processing automotive components may be a very important element. That is, automotive components may be deformed in various directions, rather than in one axial direction as in a tensile test. When deviation of directional material is great, the degree of deformation may vary by direction, so that cracking caused by processing may occur in a portion of the material deformed at a low level. Uniform deformation should occur in all directions to increase, for example, a hole expansion ratio (HER) considered to be an important forming factor for a 780 MPa or higher grade material. When the deformation is concentrated on a specific portion of the material, stress may be focused in a deformation concentration direction to cause cracking in the specific portion, thus degrading HER. Such HER may be excellent as a strength difference between respective phases within microstructures of the material is low. However, even though the difference is low, when the deviation of directional material is high, cracking may first occur in a direction in which the material has high strength, thus causing degradation of HER.

The present inventors confirmed that, as a result of a correlation between inspected forming characteristics of high-strength steel and directional strength, when the strength of the high-strength steel in a direction perpendicular to a rolling direction and in the rolling direction was controlled to 50 MPa or lower, degradation of formability depending on deviation of directional material could be significantly reduced.

It was confirmed that, to reduce deviation of the directional strength proposed in the present disclosure, a low-yield-ratio high-strength steel sheet having excellent formability, a tensile strength of 780 MPa or higher, and a yield ratio (YR) of 0.75 or less could be obtained by optimizing a composition of the steel using a composition proposed in an exemplary embodiment in the present disclosure, 1) forming a microstructure of a steel sheet, including, by area %, 40% or more of ferrite, 10% or less of bainite, 3% or less of austenite, and a balance of martensite, and 2) controlling the fraction of a Mn band, present within the martensite, to 5% or less. As for the above-mentioned microstructure, hot-rolled steel may be cold rolled at a reduction ratio of 40 to 70%, may be maintained at a temperature range of Ac1+30° C. to Ac3+30° C. in an annealing process, may be primarily cooled to 650 to 700° C. at a cooling rate of 1 to 10° C./s, and may be rapidly cooled to a temperature range of Ms−50° C. or lower at a cooling rate of 5 to 30° C./s, thus preventing tempered martensite from being generated.

The high-strength steel sheet, according to an exemplary embodiment in the present disclosure, may be formed of a dual-phase microstructure in which hard fine martensite may be primarily dispersed into soft ferrite having good ductility. In detail, the microstructure of the steel sheet, according to an exemplary embodiment in the present disclosure, may include, by area %, 40% or more of ferrite, 10% or less of bainite, 3% or less of austenite, and a balance of martensite.

The ferrite may be required to have a sufficient level of ductility and, in an exemplary embodiment in the present disclosure, may, by fraction, account for 40% or more of the overall microstructure.

The fraction of the martensite may be one of the most important requirements in an exemplary embodiment in the present disclosure. To achieve a tensile strength of 780 MPa or higher, the fraction of the martensite in the overall microstructure may be required to be 20% or more. When the fraction of the martensite exceeds 50%, a sufficient level of ductility may not be obtained. Thus, the fraction of the martensite in the overall microstructure may preferably be restricted to 20 to 50%.

Further, in an exemplary embodiment in the present disclosure, the fraction of the bainite may be restricted to 10% or less, which may be performed to inhibit YS and YR from being increased. Such bainite may be removed. In an exemplary embodiment in the present disclosure, the austenite may be required to have a small fraction, and thus an upper limit of the fraction of the austenite may be restricted to 3%, preferably 1% or less, and more preferably 0.

Meanwhile, in an exemplary embodiment in the present disclosure, to reduce the deviation of directional strength of the steel sheet, the fraction of the Mn band present within the martensite may be controlled in addition to the above-mentioned distribution of the microstructure inside the steel sheet.

Such an Mn band may be generated as, in steel containing large amounts of C and Mn, a C- and Mn-rich layer, primarily aggregated along grain boundaries thereof in an operation of cooling a steel slab, is tensioned when the steel slab is hot rolled and then cooled. The Mn band may commonly include a second phase group formed in an annealed steel sheet to have a columnar shape and a layer shape in the rolling direction or in a sheet width direction.

The present inventors confirmed that, in the annealed steel sheet, when the fraction of the Mn band in the martensite exceeded 5%, based on 100% of the fraction of the martensite, ductility and YR of the annealed steel sheet were markedly changed, and that, when the fraction of the Mn band is 5% or less, steel having excellent formability, such as, for example, a bendability (R/t) of 0.5 or less and a HER of 30% or more, as well as a low YR of 0.75 or less, could be manufactured.

In an exemplary embodiment in the present disclosure, as a method for restricting the fraction of the Mn band within the martensite to 5% or less, two control factors were largely considered.

First, a soft reduction process may be performed in a continuous casting process at the time of manufacturing steel using a composition proposed in an exemplary embodiment in the present disclosure.

Generally, a process of manufacturing steel may manufacture a steel slab through a casting process after controlling contents of components required for steel making in a molten metal, manufactured in a blast furnace, by a steel converter. However, since the molten metal is cooled in the casting process while flowing at a very low rate, at the time of cooling the molten metal, heavy elements such as Mn may frequently be present as segregations in a center portion of the steel slab. Even though passing through subsequent hot and cold rolling processes, such segregations may be present in the center portion of the steel to form a band. Once formed, the band may be difficult to remove.

Thus, as a result of this examination, the present inventors reached a conclusion that, to fundamentally control the formation of the band described above, it would be preferable to remove the formation of the band from the casting process. To this end, the inventors came to a conclusion that it could be preferable to apply the soft reduction process to the continuous casting process. As illustrated in FIG. 1, soft reduction may be a technology for inhibiting enriched molten steel, present between columnar crystals, from flowing to a center portion of a steel slab by pressing the steel slab by the extent of solidification contraction at the end of solidification of the continuous casting process. The present inventors confirmed that segregations were removed from a center portion of an ultimate cast microstructure, as illustrated in FIG. 2, by controlling such soft reduction technology.

Second, a predetermined amount of Si or more may be added to steel to remove a Mn band.

Generally, Si may be an element very advantageous in inhibiting segregations of a microstructure by preventing pearlite from being generated during a hot rolling process through an increase in activities of C. Thus, the addition of Si may reduce the thickness of the Mn band, and the Mn band may finely be dispersed into the steel. As a result, since enriched amounts of C and Mn included in austenite are increased by Si even in a continuous annealing process, martensite may be dispersed into a base of ferrite after cooling. To obtain such an effect, Si may be required to be added in a minimum amount of 0.2% or more. However, when the content of Si exceeds 1.5%, the effect of removing the Mn band by Si may be excellent, but the surface enrichment of Si may cause a defect, such as bare spots, at the time of manufacturing a hot-dip galvanized steel sheet. Thus, the content of Si may be restricted to 0.2 to 1.5%.

Meanwhile, as a method for controlling bare spots during a galvanizing process, an exemplary embodiment in the present disclosure may require controlling correlation between Si and Mn in addition to the controlling of Si. To reduce bare spots in the manufacture of the hot-dip galvanized steel sheet, $SiO_2$ generated on the surface of the steel sheet may be required to be inhibited as far as possible. The experiment, conducted by the present inventors, showed that a Si/(Si+Mn) ratio of the composition was controlled to 0.5 or less, so that the influence of $SiO_2$ generated on the surface of the steel sheet was decreased due to the enrichment of Mn on the surface of the steel sheet more dominant than that of Si on the surface of the steel sheet, thus preventing bare spots from being generated. Such control of the contents of Si and Mn may inhibit Si from being added in an excessive amount, thus providing a significantly great effect in terms of reducing internal oxidation or the like in a hot rolling process. (a), (b) of FIG. 3 are results of hot rolling steel having a Si/(Si+Mn) ratio greater than 0.5 and that having a Si/(Si+Mn) ratio of 0.5 or less and observing surfaces of hot-rolled steel sheets. As illustrated in (a) of FIG. 3, it can be seen that, when the Si/(Si+Mn) ratio exceeds 0.5, oxidation proceeds deep inside the steel sheet. Even though the steel is subjected to pickling, cold rolling, and annealing processes, such internal oxidation may occur inside the steel to degrade platability, as well as to cause deterioration of material, through acting as a trigger for cracking in the steel when an external stress occurs thereon. Thus, this may deviate from characteristics of the present disclosure to reduce the deviation of directional material. In contrast, as illustrated in (b) of FIG. 3, when the Si/(Si+Mn) ratio is 0.5 or less, internal oxidation of the hot-rolled steel sheet did not occur at all. Accordingly, platability of a hot-dip galvanized steel sheet was also excellent.

Hereinafter, the composition, according to an exemplary embodiment in the present disclosure, and a reason to restrict the composition will be detailed.

Carbon (C) may be a very important element added to reinforce transformation texture. C may promote achieving high strength, and may accelerate formation of martensite in complex phase steel. When the content of C increases, the amount of martensite included in steel may increase. However, when the content of C exceeds 0.15%, weldability may deteriorate, and formation of a segregation layer may cause a degradation of formability. In contrast, when the content of C drops to 0.05% or less, martensite is not hardened, and is difficult to obtain at a required fraction, a sufficient level of strength may not be provided. Thus, in an exemplary embodiment in the present disclosure, the content of C may preferably be restricted to 0.05 to 0.15%.

Silicon (Si) may promote ferrite transformation, may increase the content of C included in untransformed austenite to easily form a dual phase of ferrite and martensite, and may also cause a solid solution strengthening effect of Si itself. Si may be an element very useful to ensure strength and material properties. However, since Si degrades chemical conversion properties and galvanizing properties, as well as causing a surface scale defect in relation to surface properties, the content of Si may preferably be restricted. In an exemplary embodiment in the present disclosure, Si may preferably be contained in an amount, in which galvanizing properties are not degraded while ensuring certain fractions of ferrite and martensite, for example, in an amount of 0.2 to 1.5%. When the content of Si is 0.2% or less, a sufficient amount of ferrite may not be secured so that the fraction of ferrite proposed in an exemplary embodiment in the present disclosure may not be satisfied, and thus ductility may be reduced. When the content of Si exceeds 1.5%, a problem may occur in which weldability, as well as surface properties such as platability and chemical conversion properties, may be degraded.

Manganese (Mn) may refine particles without a reduction of ductility, and may cause sulfur (S), included in steel, to precipitate as MnS, thus preventing hot shortness due to the generation of FeS. Further, Mn may be an element reinforcing steel, and may function to reduce a threshold cooling rate, at which martensite may be obtained, in dual-phase steel, thus forming martensite more easily. However, when the content of Mn is less than 2.2%, it may be difficult to ensure strength required in an exemplary embodiment in the present disclosure. In contrast, when the content of Mn exceeds 3.0%, a problem with weldability or hot rolling properties may be highly likely to occur. Further, an excessively added amount of Mn may cause a Mn band to be generated in a steel sheet microstructure having been subjected to an annealing process, and thus the content of Mn may preferably be restricted to 2.2 to 3.0%.

Phosphorus (P) may be a substitutional alloying element having the greatest solid solution strengthening effect, and may function to increase in-plane anisotropy and strength. When the content of P is less than 0.001%, a problem with manufacturing costs may be caused while not ensuring the effect of added P. In contrast, when P is added in an excessive amount, press formability may deteriorate, and steel brittleness may occur.

In this regard, in an exemplary embodiment in the present disclosure, the content of P may preferably be restricted to 0.001 to 0.10%.

S may be an impurity element included in steel, and may degrade ductility and weldability of a steel sheet. When the content of S exceeds 0.01%, S may be highly likely to degrade ductility and weldability of the steel sheet. Thus, the content of S may preferably be restricted to 0.01%.

Sol. Al may combine with oxygen included in steel to deoxidize the steel, and may be an element effective in improving martensite hardenability by distributing C, included in ferrite, to austenite as in Si. When the content of sol.Al is less than 0.01%, the above-mentioned effect may not be ensured. In contrast, when the content of sol.Al exceeds 0.1%, the effect may be saturated and manufacturing costs may increase. Thus, the content of sol.Al may preferably be restricted to 0.01 to 0.1%.

Nitrogen (N) may be an element effective in stabilizing austenite. When the content of N exceeds 0.01%, aging resistance may deteriorate. Thus, the content of N may preferably be restricted to 0.01% or less.

The steel sheet, according to an exemplary embodiment in the present disclosure, may also selectively include the following elements in addition to the composition.

First, the steel sheet, according to an exemplary embodiment in the present disclosure, may preferably include at least one of 0.05% or less of titanium (Ti) or niobium (Nb). Ti or Nb, included in steel, may be an element effective in increasing strength of the steel sheet and achieving a grain refinement. When the content of Ti or Nb exceeds 0.05%, manufacturing costs may be increased and ductility may deteriorate greatly due to an excessive amount of precipitate. Thus, the content of Ti or Nb may preferably be restricted to 0.05% or less.

Further, the steel sheet, according to an exemplary embodiment in the present disclosure, may preferably contain at least one of 0.1 to 0.7% of chromium (Cr) or 0.1% or less of molybdenum (Mo).

Cr, included in steel, may be an element added to increase hardenability of steel and ensure high strength thereof, and may increase a ratio of a second phase at the time of annealing, decrease the content of C included in untransformed austenite, and degrade hardness of martensite in a finished product to inhibit local deformation, thus contributing to an improvement in HER or bendability. Simultaneously, Cr may act to inhibit pearlite or bainite from being generated from austenite to facilitate transformation of the austenite into martensite, thus enabling the martensite to be generated at a sufficient ratio. To obtain such an effect, the content of Cr may be required to be 0.1% or more. In contrast, when the content of Cr exceeds 0.7%, the ratio of the second phase may increase excessively, or an excessive amount of Cr carbide may be generated, thus causing a degradation of ductility.

Mo, included in steel, may function to stabilize austenite and facilitate generation of a dual phase in a cooling process at the time of annealing, as well as serving as a solid solution strengthening element. However, when the content of Mo exceeds 0.1%, platability, formability, and spot weldability may deteriorate, and an excessive increase in manufacturing costs may be expected. Thus, the content of Mo may preferably be restricted to 0.1% or less.

Further, the steel sheet, according to an exemplary embodiment in the present disclosure, may also include 0.0060% or less of boron (B).

B, included in steel, may be an element delaying transformation of austenite into pearlite in a cooling process during annealing, and may be added as an element inhibiting formation of ferrite and promoting formation of bainite. However, when the content of B exceeds 0.0060%, an excessive amount of B may be enriched on a surface of the steel to cause degradation of ductility in addition to that of plating adhesion. Thus, the content of B may preferably be restricted to 0.0060% or less.

Further, the steel sheet, according to an exemplary embodiment in the present disclosure, may also include 0.5% or less of antimony (Sb).

Sb, included in steel, may be highly effective in inhibiting the enrichment of oxides, such as MnO, $SiO_2$, and $Al_2O_3$, on a surface of the steel to reduce surface defects caused by dents, and in hindering coarsening of the oxides enriched on the surface of the steel according to an increase in temperature and a change in a hot rolling process. When the content of Sb exceeds 0.5%, even in the case that the Sb content continues to increase, such an effect may not only increase greatly, but may also cause a problem such as an increase in manufacturing costs or degradation of workability. Thus, the content of Sb may preferably be restricted to 0.5% or less.

As described above, the cold-rolled steel sheet, the hot-dipped galvanized steel sheet, and the hot-dipped galvannealed steel sheet having the composition, the microstructure, and the fraction of the Mn band, according to an exemplary embodiment in the present disclosure, may have TS(tr.)−TS(lo.) and YS(tr.)−YS(lo.) of 50 MPa or lower, respectively (where tr may refer to the direction perpendicular to the rolling direction, and lo may refer to the rolling direction), so as to promote uniformity of directional material of the steel sheet.

Next, a method for manufacturing a cold-rolled steel sheet, a hot-dipped galvanized steel sheet, or a hot-dipped galvannealed steel sheet according to an exemplary embodiment in the present disclosure will be detailed.

First, in an exemplary embodiment in the present disclosure, a steel slab may be manufactured through a continuous casting process using molten steel having the composition described above. At this time, in an exemplary embodiment in the present disclosure, the steel slab may be manufactured using the soft reduction described above at the time of the continuous casting process. The soft reduction, performed in the continuous casting process, may be a method which is very effective in removing segregations from a center portion of the steel slab as described above, and may be a process required to control the fraction of a Mn band within martensite to 5% or less to ensure uniformity of directional material of the steel sheet manufactured according to an exemplary embodiment in the present disclosure.

In an exemplary embodiment in the present disclosure, the soft reduction may preferably be performed on the steel slab at a point in time at which a solid fraction fs thereof ranges from 0.5 to 0.8, for example, when the steel slab is in a solid state at a thickness of 50 to 80% thereof. When the point in time of the soft reduction is too early, the segregations may not be dispersed and may be concentrated at the end of solidification, so that the amount of the segregations in the center portion of the steel slab may significantly increase. In contrast, when the point in time of the soft reduction is too late, the steel slab may be pressed after the completion of solidification, and thus the segregations may remain in the center portion of the steel slab.

In an exemplary embodiment in the present disclosure, the range of the soft reduction may be 3 to 6 mm, based on a steel slab thickness of 250 mm. That is, a reduction ratio of the soft reduction may range from 1.2 to 2.4%. In an exemplary embodiment in the present disclosure, when the range of the soft reduction is excessively low, for example, less than 3 mm, the effect of the soft reduction may not be exhibited, and the amount of the segregations in the center portion may not be properly reduced; and when the range of the soft reduction exceeds 6 mm, a problem of equipment may occur.

Subsequently, the steel slab, manufactured through such a continuous casting process, may be reheated under normal conditions.

In the exemplary embodiment of the present disclosure, the reheated steel slab may be finish hot rolled within a temperature range of Ar3 to Ar3+50° C. When the finish hot rolling temperature is lower than Ar3, hot deformation resistance may be highly likely to increase rapidly. Further, a top, bottom, and edge portions of a hot-rolled coil may become a single phase region, so as to increase in-plane anisotropy and degrade formability. However, when the finish hot rolling temperature exceeds Ar3+50° C., excessively thick oxide scale may be generated, and a microstructure of the steel sheet may also be highly likely to coarsen.

After the completion of the finish hot rolling process, the hot-rolled steel sheet may be coiled at a temperature range of 600 to 750° C. When the coiling temperature is lower than 600° C., an excessive amount of martensite or bainite may be generated, causing an increase in strength of the hot-rolled steel sheet, and thus a manufacturing problem may occur, such as a defective shape or the like, caused by a load during a cold rolling process. In contrast, when the coiling temperature exceeds 750° C., the surface enrichment caused by elements degrading wettability of the hot-dipped galvanized layer, such as a Si, Mn, or B layer, may increase. Thus, the coiling temperature may preferably be restricted to 600 to 750° C.

Subsequently, the coiled hot-rolled steel sheet may be subjected to a pickling process under normal conditions.

In an exemplary embodiment in the present disclosure, the coiled hot-rolled steel sheet may be cold rolled at a cold reduction ratio of 40 to 70%. When the cold reduction ratio is less than 40%, recrystallization driving force may be weaken. Thus, a problem may be highly likely to occur obtaining good recrystallized grains, and it may be very difficult to correct the shape of the steel sheet. However, when the cold reduction ratio exceeds 70%, cracking may be highly likely to occur in an edge portion of the steel sheet, and the rolling load may increase rapidly.

Subsequently, in an exemplary embodiment in the present disclosure, the cold-rolled steel sheet may be subjected to a continuous annealing process. At this time, the continuous annealing temperature may preferably be at a temperature range of Ac1+30° C. to Ac3−30° C. When the continuous annealing temperature is lower than Ac1+30° C., it may be difficult to form a sufficient amount of austenite, so that the fraction of martensite, required in an exemplary embodiment in the present disclosure, may not be ensured. Further, a low annealing temperature may cause the fraction of recrystallized ferrite to be low, so that anisotropy of directional material of the steel sheet may increase. This may be a condition in which the deviation of directional strength of the steel sheet required in an exemplary embodiment in the present disclosure, for example, 50 MPa or lower, is not satisfied. In contrast, when the annealing temperature exceeds Ac3−30° C., an excessive amount of austenite may be formed, so that the amount of bainite may increase rapidly, and thus the fraction of bainite, for example, 10% or less, proposed in an exemplary embodiment in the present disclosure may not be satisfied. Such an increase in the fraction of the bainite may cause an excessive increase in YS and degradation of ductility.

Subsequently, in an exemplary embodiment in the present disclosure, the steel sheet soaked and annealed in the continuous annealing process may primarily be cooled to a temperature range of 650 to 700° C. The primary cooling process may be performed to ensure an equilibrium carbon concentration of ferrite and austenite to increase ductility and strength of the steel sheet. When the primary cooling end temperature is below 650° C. or above 700° C., it may be difficult to ensure ductility and strength of the steel sheet required in an exemplary embodiment in the present disclosure. Thus, the primary cooling end temperature may preferably be restricted to 650 to 700° C. In an exemplary embodiment in the present disclosure, a cooling rate during the primary cooling process may preferably be 1 to 10° C./s.

Subsequently, in an exemplary embodiment in the present disclosure, the primarily cooled steel sheet may secondarily be cooled to a temperature range of Ms−50° C. or lower. The secondary cooling process may cool the primarily cooled steel sheet to a temperature of Ms−50° C. or lower. This may be provided to inhibit tempered martensite from being generated by ensuring martensite through rapid cooling and retaining the martensite at low temperatures. The tempered martensite may function to increase YS by a carbide precipitated within the martensite when being maintained at a constant temperature after being rapidly cooled to Ms or lower. As in the case of the present disclosure, it may be advantageous to inhibit tempered martensite from being generated as far as possible in order to ensure a low YR. Considering this, in an exemplary embodiment in the present disclosure, the primarily cooled steel sheet may secondarily be cooled to a temperature range of Ms−50° C. or lower. At this time, a cooling rate may preferably be maintained at 5 to 30° C./s.

In an exemplary embodiment in the present disclosure, a skin-pass rolling process may be performed on the secondarily cooled steel sheet as desired. At this time, a reduction ratio may preferably be 0.2 to 1.0%. Generally, when advanced high strength steel (AHSS) is subjected to a skin-pass rolling process, YS thereof may increase to at least 50 MPa or higher almost without an increase in TS. However, when an elongation of AHSS is less than 0.2%, it may be very difficult to control the shape thereof in the manufacturing of super high strength steel as in an exemplary embodiment in the present disclosure. When AHSS having an elongation of 1.0% or more is worked, YS may increase excessively, for example, the steel sheet may exceed greater than 0.75 of YR, required in an exemplary embodiment in the present disclosure, and a high elongation operation may cause workability to be greatly unstable.

Meanwhile, the steel sheet may be subjected to the hot rolling, cold rolling, continuous annealing, and primary cooling processes to manufacture the hot-dipped galvanized steel sheet in an exemplary embodiment in the present disclosure, as in the above-mentioned manufacturing conditions of the cold-rolled steel sheet. Thereafter, the steel sheet may secondarily be cooled to a temperature range of 600° C. or lower at an average cooling rate of 3 to 30° C./s in a secondary cooling process.

At this time, when the average cooling rate is less than 3° C./s, ferrite transformation may proceed during cooling to reduce the fraction of martensite, thus causing degradation of strength, while impairing uniformity of material due to non-uniformly generated ferrite. In contrast, when the average cooling rate exceeds 30° C./s, the effect of inhibiting ferrite transformation may be saturated, while the fraction of martensite is excessive, thus causing degradation of elongation and HER.

Further, when a secondary cooling end temperature exceeds 600° C., the fraction of martensite may significantly be reduced due to the generation of ferrite or pearlite, for example, the fraction of the martensite in the entirety of the microstructure may be less than 20%. Thus, a TS of 780 MPa or higher may not be obtained, and uniformity of material may be impaired due to non-uniformly generated ferrite or pearlite.

The secondarily cooled steel sheet may also be skin-pass rolled at a reduction ratio of 0.2 to 1.0% as desired.

Subsequently, in an exemplary embodiment in the present disclosure, the secondarily cooled steel sheet may be annealed under normal conditions, and may be galvanized to manufacture a hot-dipped galvanized steel sheet. The hot-dipped galvanizing process may be performed under normal conditions after the annealing process.

Further, in an exemplary embodiment in the present disclosure, the hot-dipped galvanized steel sheet as described above may be galvannealed to manufacture a hot-dipped galvannealed steel sheet. Such a hot-dipped galvannealing process may be performed at a temperature range of 450 to 600° C., so that the content of iron (Fe) in the galvanized layer may be 8 to 12%, thus improving plating adhesion or corrosion resistance after plating. In contrast, when the galvannealing temperature is lower than 450° C., the hot-dipped galvannealing process may proceed insufficiently, and a sacrificial protection action or plating adhesion may also deteriorate. When the galvannealing temperature exceeds 600° C., the hot-dipped galvannealing process may proceed excessively to degrade powdering properties, or a large amount of pearlite or bainite may be generated to cause a lack of strength or degradation of HER.

In an exemplary embodiment in the present disclosure, other manufacturing method conditions are not particularly limited and, in terms of productivity, a series of processes, such as the annealing, hot-dipped galvanizing, and hot-dipped galvannealing processes may preferably be performed on a continuous galvanizing line. Further, the hot-dipped galvanizing process may preferably be performed using a galvanizing bath including the content of aluminum (Al) of 0.10 to 0.20%.

According to an exemplary embodiment in the present disclosure, the cold-rolled steel sheet, the hot-dipped galvanized steel sheet, or the hot-dipped galvannealed steel sheet, manufactured through the above-mentioned manufacturing processes, may have a microstructure including 40% or more of ferrite, 10% or less of bainite, 3% or less of retained austenite, and a balance of martensite, and may have 5% or less of the fraction of a Mn band present within the martensite.

Further, the hot-dipped galvanized steel sheet or the hot-dipped galvannealed steel sheet may have 50 MPa or lower of TS(tr.)–TS(lo.) and YS(tr.)–YS(lo.), respectively, where tr may refer to the direction perpendicular to the rolling direction and lo may refer to the rolling direction.

MODE FOR INVENTION

Hereinafter, exemplary embodiments in the present disclosure will be described in detail through examples.

Examples

Steel slabs, having compositions illustrated in Table 1 below, were prepared (in the case that a soft reduction process was applied to the steel slabs, the soft reduction process was performed at a point in time at which a solid fraction during a continuous casting process was 60%. At this time, the steel slabs were worked at a range of the soft reduction of 5 mm, for example, at a reduction ratio of 2%), heated in a heating furnace at a reheating temperature of 1,200° C. for one hour, and then hot rolled to manufacture hot-rolled steel sheets, and the hot-rolled steel sheets were coiled. At this time, the hot rolling process was ended at a temperature range of 880 to 900° C. immediately above Ar3, and the coiling temperature was set to 680° C. The hot-rolled steel sheets were pickled, and then cold rolled at a cold reduction ratio of 50%.

The cold-rolled steel sheets were continuously annealed under the conditions illustrated in Table 2. The continuously annealed steel sheets were then primarily cooled to a temperature of 650° C., and secondarily cooled under the conditions illustrated in Table 2 to manufacture ultimate cold-rolled steel sheets.

To manufacture hot-dipped galvanized steel sheets, the cold-rolled steel sheets were continuously annealed under the conditions illustrated in Table 4. The continuously annealed steel sheets were then primarily cooled to a temperature of 650° C., and secondarily cooled to a temperature range of 600° C. or lower. Thereafter, the cooled steel sheets were dipped into a galvanizing pot maintained at a certain temperature to manufacture the hot-dipped galvanized steel sheets having hot-dipped galvanized layers on surfaces thereof. Subsequently, a portion of the hot-dipped galvanized steel sheets was subjected to a hot-dipped galvannealing process at a temperature range of 500° C. to manufacture hot-dipped galvannealed steel sheets. An ultimate skin-pass rolling ratio for the annealed steels was fixed to 0.7%.

In Table 1 below, Steel Nos. 18 and 24 were only used in the manufacturing of the hot-dipped galvanized steel sheets, and Steel Nos. 26-34 were only used in the manufacture of the cold-rolled steel sheets. The remaining steels were simultaneously used in the manufacturing of the cold-rolled steel sheets and the hot-dipped galvanized steel sheets. Tables 2 and 3 below illustrate the cold-rolled steel sheets. Further, in Tables 4 and 5 below, Steels Nos. 1-3 and 16-19 show the hot-dipped galvanized (GI) steel sheet, and the remaining steels illustrate hot-dipped galvannealed (GA) steel sheets.

Further, Tables 2 and 3 below illustrate the mechanical properties of the ultimate cold-rolled steel sheets manufactured as described above, and the fractions of transformation phases thereof, and Tables 4 and 5 below illustrate the mechanical properties of the hot-dipped galvanized/galvannealed steel sheets manufactured as described above, and the fractions of transformation phases thereof.

JIS 5 tensile test specimens were produced from the continuously annealed cold-rolled steel sheets to measure material properties. Further, in Tables 2 and 4 below, the bendability is represented by processing the specimens in a V bending manner, observing whether cracking occurs in surfaces of the specimens while changing an internal radius (R) of a bent portion of each specimen from 0 to 5, expressing an ultimate R, at which cracking does not occur, as bendability of a corresponding steel, an R value, and dividing the R value by the thickness of the steel. In addition, the HERs were evaluated by applying the standards of Japanese JSF T1001-1996. The fractions of transformation phases, illustrated in Tables 3 and 5 below, were measured using an image analyzer after being imaged with a scanning electron microscope (SEM)

TABLE 1

| Steel | Composition (wt %) | | | | | | | | | | | | | | Soft |
|---|---|---|---|---|---|---|---|---|---|---|---|---|---|---|---|
| No. | C | Si | Mn | P | S | S.Al | Cr | Mo | Ti | Nb | N | B | Sb | S* | Reduction |
| 1-1 | 0.07 | 0.4 | 2.3 | 0.01 | 0.003 | 0.04 | 0.25 | 0.01 | 0.02 | 0.03 | 0.0048 | 0.0005 | 0.03 | 0.148 | Applied |
| 1 | | | | | | | | | | | | | | | Applied |
| 2-1 | 0.08 | 0.4 | 2.5 | 0.009 | 0.002 | 0.05 | 0.5 | 0.02 | 0.021 | 0.02 | 0.005 | 0.0005 | 0.02 | 0.138 | Not Applied |
| 2 | | | | | | | | | | | | | | | Applied |
| 3 | 0.09 | 0.5 | 2.5 | 0.01 | 0.005 | 0.035 | 0.65 | 0 | 0.022 | 0.045 | 0.003 | 0 | 0.03 | 0.167 | Applied |
| 4-1 | 0.12 | 0.6 | 2.4 | 0.009 | 0.004 | 0.06 | 0.7 | 0 | 0.04 | 0 | 0.004 | 0.0025 | 0 | 0.200 | Not Applied |
| 4 | | | | | | | | | | | | | | | Applied |
| 5 | 0.15 | 1 | 2.3 | 0.01 | 0.003 | 0.07 | 0.3 | 0.04 | 0.03 | 0.02 | 0.0056 | 0.0025 | 0.02 | 0.303 | Applied |
| 6 | 0.11 | 0.8 | 2.2 | 0.01 | 0.003 | 0.05 | 0.2 | 0 | 0.02 | 0.03 | 0.005 | 0.0025 | 0.03 | 0.267 | Applied |
| 7 | 0.1 | 0.7 | 2.2 | 0.01 | 0.003 | 0.04 | 0.6 | 0.03 | 0.025 | 0.02 | 0.0047 | 0.0025 | 0.02 | 0.241 | Applied |
| 8 | 0.075 | 0.5 | 2.8 | 0.011 | 0.005 | 0.055 | 0.5 | 0.01 | 0.035 | 0 | 0.001 | 0.0025 | 0.04 | 0.152 | Applied |
| 9-1 | 0.085 | 0.6 | 2.9 | 0.011 | 0.004 | 0.045 | 0.6 | 0.02 | 0.045 | 0 | 0.006 | 0.0025 | 0.03 | 0.171 | Not Applied |
| 9 | | | | | | | | | | | | | | | Applied |
| 10 | 0.14 | 0.29 | 2.5 | 0.013 | 0.0015 | 0.042 | 0.38 | 0.062 | 0 | 0.006 | 0.0052 | 0.0003 | 0 | 0.104 | Applied |
| 11-1 | 0.09 | 0.9 | 2.3 | 0.012 | 0.005 | 0.06 | 0.3 | 0 | 0.035 | 0.045 | 0.0045 | 0.0025 | 0.03 | 0.281 | Not Applied |
| 11 | | | | | | | | | | | | | | | Applied |
| 12 | 0.09 | 0.5 | 2.3 | 0.01 | 0.003 | 0.05 | 0.3 | 0.01 | 0 | 0.045 | 0.0041 | 0 | 0.04 | 0.179 | Applied |
| 13 | 0.1 | 0.6 | 2.4 | 0.011 | 0.004 | 0.05 | 0.25 | 0 | 0 | 0.035 | 0.0035 | 0.0005 | 0.02 | 0.200 | Applied |
| 14 | 0.105 | 0.5 | 2.5 | 0.01 | 0.005 | 0.04 | 0.3 | 0.01 | 0.01 | 0.04 | 0.0055 | 0.0005 | 0.05 | 0.167 | Applied |
| 15 | 0.09 | 0.5 | 2.2 | 0.012 | 0.003 | 0.035 | 0.4 | 0 | 0 | 0.05 | 0.0065 | 0 | 0.03 | 0.185 | Applied |
| 16 | 0.09 | 0.8 | 2.3 | 0.009 | 0.005 | 0.035 | 0.3 | 0.02 | 0.01 | 0.04 | 0.002 | 0.0025 | 0 | 0.258 | Applied |
| 17 | 0.1 | 0.1 | 2.5 | 0.01 | 0.006 | 0.04 | 0.65 | 0.06 | 0.01 | 0.04 | 0.005 | 0.0025 | 0.02 | 0.038 | Applied |
| 18 | 0.13 | 2.5 | 2.3 | 0.011 | 0.005 | 0.03 | 0.55 | 0.09 | 0.02 | 0.05 | 0.006 | 0.0025 | 0.03 | 0.521 | Applied |
| 19 | 0.19 | 0.5 | 2.9 | 0.011 | 0.006 | 0.05 | 0.45 | 0.06 | 0.025 | 0.055 | 0.0065 | 0.0025 | 0.05 | 0.147 | Applied |
| 20 | 0.07 | 0.5 | 2.5 | 0.008 | 0.002 | 0.04 | 0.85 | 0.25 | 0.02 | 0.04 | 0.004 | 0.0025 | 0.04 | 0.167 | Applied |
| 21 | 0.04 | 0.4 | 2.7 | 0.011 | 0.003 | 0.06 | 0.65 | 0.08 | 0.04 | 0.03 | 0.005 | 0.0025 | 0.03 | 0.129 | Applied |
| 22 | 0.09 | 0.5 | 2.4 | 0.015 | 0.007 | 0.05 | 0.3 | 0 | 0 | 0.02 | 0.005 | 0.001 | 0.01 | 0.172 | Applied |
| 23 | 0.1 | 0.6 | 2.3 | 0.011 | 0.006 | 0.06 | 0.25 | 0 | 0.03 | 0 | 0.005 | 0.0025 | 0.01 | 0.207 | Applied |
| 24 | 0.105 | 2.3 | 2.2 | 0.009 | 0.005 | 0.04 | 0.4 | 0.01 | 0.01 | 0.01 | 0.003 | 0.001 | 0 | 0.511 | Applied |
| 25 | 0.09 | 0.5 | 2.3 | 0.011 | 0.004 | 0.04 | 0.5 | 0 | 0 | 0.02 | 0.005 | 0.002 | 0.01 | 0.179 | Not Applied |
| 26 | 0.07 | 0.5 | 2.3 | 0.01 | 0.003 | 0.04 | 0 | 0 | 0 | 0 | 0.0038 | 0 | 0 | 0.179 | Applied |
| 27 | 0.08 | 0.7 | 2.5 | 0.012 | 0.002 | 0.05 | 0.4 | 0 | 0 | 0 | 0.005 | 0 | 0 | 0.219 | Applied |
| 28 | 0.15 | 1.1 | 2.4 | 0.01 | 0.003 | 0.07 | 0 | 0.05 | 0 | 0 | 0.0035 | 0 | 0 | 0.314 | Applied |
| 29 | 0.1 | 0.7 | 2.3 | 0.01 | 0.003 | 0.04 | 0.6 | 0.04 | 0 | 0 | 0.0047 | 0 | 0 | 0.233 | Applied |
| 30 | 0.11 | 0.9 | 2.2 | 0.01 | 0.003 | 0.05 | 0 | 0 | 0.03 | 0 | 0.005 | 0 | 0 | 0.290 | Applied |
| 31 | 0.1 | 0.7 | 2.4 | 0.011 | 0.004 | 0.05 | 0 | 0 | 0 | 0.04 | 0.004 | 0 | 0 | 0.226 | Applied |
| 32 | 0.13 | 0.8 | 2.3 | 0.01 | 0.003 | 0.07 | 0 | 0 | 0.03 | 0.02 | 0.005 | 0 | 0 | 0.258 | Applied |
| 33 | 0.075 | 0.8 | 2.6 | 0.011 | 0.005 | 0.055 | 0 | 0 | 0 | 0 | 0.001 | 0.0025 | 0 | 0.235 | Applied |
| 34-1 | 0.09 | 1 | 2.8 | 0.011 | 0.004 | 0.045 | 0 | 0 | 0 | 0 | 0.006 | 0.0025 | 0.03 | 0.263 | Not Applied |
| 34 | | | | | | | | | | | | | | | Applied |

In Table 1, S* may refer to Si/(Si + Mn).

TABLE 2

| Steel No. | SS (° C.) | RCS (° C.) | YS (MPa) | TS (MPa) | T-El (%) | YR | ΔYS | ΔTS | R/t | HER (%) | Note |
|---|---|---|---|---|---|---|---|---|---|---|---|
| 1-1 | 800 | 250 | 690.3 | 989.7 | 12.8 | 0.70 | 86.8 | 55.2 | 0.2 | 20 | Comparative Example 1-1 |
| 1 | | | 634.6 | 983.4 | 14.4 | 0.65 | 27.2 | 21.2 | 0.1 | 35 | Inventive Example 1 |
| 2-1 | 810 | 270 | 581.2 | 980.6 | 12.7 | 0.59 | 92.3 | 65.3 | 0.3 | 20 | Comparative Example 2-1 |
| 2 | | | 686.8 | 1005.1 | 13.6 | 0.68 | 28.2 | 13.5 | 0.1 | 40 | Inventive Example 2 |
| 3 | 800 | 250 | 621.1 | 1060.2 | 13.6 | 0.59 | 23.2 | 20.3 | 0 | 40 | Inventive Example 3 |
| 4-1 | 810 | 250 | 661.6 | 1039.9 | 12.6 | 0.64 | 107.4 | 63.5 | 0.4 | 25 | Comparative Example 4-1 |
| 4 | | | 663.4 | 1029.6 | 14.1 | 0.64 | 34.3 | 25.3 | 0.1 | 40 | Inventive Example 4 |
| 5 | 790 | 270 | 630.9 | 1022.6 | 13.4 | 0.62 | 11.8 | 10.3 | 0 | 45 | Inventive Example 5 |
| 6 | 800 | 250 | 601.8 | 1016.6 | 14.1 | 0.59 | 24.8 | 15.6 | 0 | 35 | Inventive Example 6 |
| 7 | 800 | 250 | 624.6 | 1026.2 | 14.5 | 0.61 | 16.3 | 14.3 | 0.1 | 40 | Inventive Example 7 |

TABLE 2-continued

| Steel No. | SS (° C.) | RCS (° C.) | YS (MPa) | TS (MPa) | T-El (%) | YR | ΔYS | ΔTS | R/t | HER (%) | Note |
|---|---|---|---|---|---|---|---|---|---|---|---|
| 8 | 810 | 250 | 557.7 | 995.5 | 13.1 | 0.56 | 27.1 | 20.6 | 0 | 40 | Inventive Example 8 |
| 9-1 | 800 | 300 | 611.2 | 988.3 | 13.1 | 0.62 | 77.9 | 51.2 | 0.1 | 20 | Comparative Example 9-1 |
| 9 | | | 628.4 | 1014.5 | 16.4 | 0.62 | 23.8 | 15.3 | 0.4 | 35 | Inventive Example 9 |
| 10 | 800 | 300 | 689.1 | 1082.7 | 14.0 | 0.64 | 20.1 | 9.9 | 0.4 | 35 | Inventive Example 10 |
| 11-1 | 810 | 250 | 457.7 | 799.6 | 19.9 | 0.57 | 64 | 52.1 | 0.2 | 25 | Comparative Example 11-1 |
| 11 | | | 423.3 | 825.0 | 21.8 | 0.51 | 27.3 | 20.2 | 0.3 | 40 | Inventive Example 11 |
| 12 | 800 | 250 | 462.0 | 793.0 | 18.0 | 0.58 | 25.4 | 15.5 | 0 | 45 | Inventive Example 12 |
| 13 | 800 | 250 | 493.3 | 798.9 | 21.3 | 0.62 | 26.8 | 10.1 | 0 | 50 | Inventive Example 13 |
| 14 | 800 | 250 | 474.4 | 781.7 | 19.2 | 0.61 | 16.8 | 9.6 | 0.2 | 50 | Inventive Example 14 |
| 15 | 800 | 250 | 494.9 | 814.7 | 18.3 | 0.61 | 34.1 | 22.5 | 0.1 | 45 | Inventive Example 15 |
| 16 | 800 | 250 | 434.9 | 822.2 | 18.6 | 0.53 | 33.9 | 10.2 | 0.1 | 40 | Inventive Example 16 |
| 17 | 800 | 250 | 752.0 | 1074.4 | 11.2 | 0.70 | 76.3 | 65.6 | 0.1 | 20 | Comparative Example 17 |
| 19 | 800 | 250 | 852.1 | 1285.1 | 10.1 | 0.66 | 56.5 | 50.6 | 0.7 | 15 | Comparative Example 19 |
| 20 | 800 | 250 | 853.6 | 1089.5 | 11.3 | 0.78 | 42.0 | 33.5 | 1.2 | 25 | Comparative Example 20 |
| 21 | 800 | 250 | 554.3 | 912.7 | 15.2 | 0.61 | 62.5 | 55.2 | 0.4 | 35 | Comparative Example 21 |
| 22 | 750 | 250 | 425.6 | 812.3 | 10.6 | 0.52 | 102.3 | 96.3 | 1.5 | 15 | Comparative Example 22 |
| 23 | 890 | 250 | 672.3 | 853.6 | 11.1 | 0.79 | 96.3 | 58.2 | 2 | 20 | Comparative Example 23 |
| 25 | 800 | 250 | 475.6 | 799.6 | 18.1 | 0.59 | 65.8 | 55.9 | 0.8 | 25 | Comparative Example 25 |
| 26 | 800 | 250 | 514.6 | 783.4 | 23.4 | 0.66 | 26.3 | 19.2 | 0.2 | 55 | Inventive Example 26 |
| 27 | 810 | 270 | 486.8 | 837.9 | 21.6 | 0.58 | 20.2 | 11.5 | 0.1 | 60 | Inventive Example 27 |
| 28 | 790 | 270 | 530.9 | 822.6 | 22.4 | 0.65 | 11.8 | 12.3 | 0.1 | 65 | Inventive Example 28 |
| 29 | 800 | 250 | 564.6 | 926.2 | 19.5 | 0.61 | 15.3 | 14.3 | 0.2 | 50 | Inventive Example 29 |
| 30 | 800 | 250 | 501.8 | 816.6 | 19.1 | 0.61 | 22.8 | 15.9 | 0.1 | 55 | Inventive Example 30 |
| 31 | 800 | 250 | 513.3 | 798.9 | 20.3 | 0.64 | 22.8 | 12.1 | 0 | 50 | Inventive Example 31 |
| 32 | 790 | 270 | 631.9 | 982.6 | 15.4 | 0.64 | 15.8 | 17.3 | 0 | 45 | Inventive Example 32 |
| 33 | 810 | 250 | 497.7 | 785.5 | 19.1 | 0.63 | 27.1 | 19.6 | 0.1 | 45 | Inventive Example 33 |
| 34-1 | 800 | 300 | 531.2 | 798.3 | 17.1 | 0.67 | 78.9 | 53.2 | 0.2 | 35 | Comparative Example 34-1 |
| 34 | | | 518.4 | 814.5 | 19.4 | 0.64 | 21.8 | 15.9 | 0.2 | 55 | Inventive Example 34 |

In Table 2, SS may refer to a continuous annealing temperature, RCS may refer to a secondary cooling end temperature, and ΔYS and ΔTS may refer to differences between YS and TS in the direction perpendicular to the rolling direction and in the rolling direction, respectively.

TABLE 3

| Steel No. | Ferrite Fraction (%) | Martensite Fraction (%) | Bainite Fraction (%) | Retained Austenite Fraction (%) | Mn Band Fraction (%) | Note |
|---|---|---|---|---|---|---|
| 1-1 | 55 | 40 | 5 | 0 | 10 | Comparative Example 1-1 |
| 1 | | | | | 2 | Inventive Example 1 |

TABLE 3-continued

| Steel No. | Ferrite Fraction (%) | Martensite Fraction (%) | Bainite Fraction (%) | Retained Austenite Fraction (%) | Mn Band Fraction (%) | Note |
|---|---|---|---|---|---|---|
| 2-1 | 60 | 37 | 2 | 1 | 8 | Comparative Example 2-1 |
| 2 | | | | | 0 | Inventive Example 2 |
| 3 | 55 | 40 | 5 | 0 | 2 | Inventive Example 3 |
| 4-1 | 53 | 45 | 2 | 0 | 12 | Comparative Example 4-1 |
| 4 | | | | | 3 | Inventive Example 4 |
| 5 | 45 | 50 | 3 | 2 | 0 | Inventive Example 5 |
| 6 | 50 | 45 | 4 | 1 | 1 | Inventive Example 6 |
| 7 | 52 | 44 | 2 | 2 | 0 | Inventive Example 7 |
| 8 | 55 | 40 | 5 | 0 | 2 | Inventive Example 8 |
| 9-1 | 45 | 45 | 8 | 2 | 10 | Comparative Example 9-1 |
| 9 | | | | | 3 | Inventive Example 9 |
| 10 | 53 | 45 | 2 | 0 | 2 | Inventive Example 10 |
| 11-1 | 60 | 35 | 5 | 0 | 8 | Comparative Example 11-1 |
| 11 | | | | | 1 | Inventive Example 11 |
| 12 | 65 | 35 | 0 | 0 | 1 | Inventive Example 12 |
| 13 | 67 | 30 | 3 | 0 | 2 | Inventive Example 13 |
| 14 | 65 | 30 | 3 | 2 | 0 | Inventive Example 14 |
| 15 | 60 | 40 | 0 | 0 | 0 | Inventive Example 15 |
| 16 | 55 | 40 | 3 | 2 | 1 | Inventive Example 16 |
| 17 | 40 | 40 | 20 | 0 | 15 | Comparative Example 17 |
| 19 | 30 | 55 | 15 | 0 | 10 | Comparative Example 19 |
| 20 | 25 | 60 | 15 | 0 | 15 | Comparative Example 20 |
| 21 | 60 | 35 | 5 | 0 | 7 | Comparative Example 21 |
| 22 | 30 | 40 | 30 | 0 | 5 | Comparative Example 22 |
| 23 | 20 | 30 | 50 | 0 | 10 | Comparative Example 23 |
| 25 | 55 | 40 | 5 | 0 | 10 | Comparative Example 25 |
| 26 | 65 | 30 | 5 | 0 | 2 | Inventive Example 26 |
| 27 | 67 | 31 | 2 | 0 | 1 | Inventive Example 27 |
| 28 | 65 | 30 | 2 | 3 | 0 | Inventive Example 28 |
| 29 | 58 | 39 | 1 | 2 | 2 | Inventive Example 29 |
| 30 | 60 | 35 | 4 | 1 | 1 | Inventive Example 30 |
| 31 | 67 | 28 | 5 | 0 | 1 | Inventive Example 31 |
| 32 | 40 | 52 | 5 | 3 | 1 | Inventive Example 32 |
| 33 | 65 | 31 | 4 | 0 | 3 | Inventive Example 33 |
| 34-1 | 65 | 32 | 3 | 0 | 11 | Comparative Example 34-1 |
| 34 | | | | | 2 | Inventive Example 34 |

TABLE 4

| Steel No | SS | YS (MPa) | TS (MPa) | T-El (%) | YR | ΔYS | ΔTS | R/t | HER (%) | Note |
|---|---|---|---|---|---|---|---|---|---|---|
| 1-1 | 800 | 710.3 | 1009.7 | 12.5 | 0.70 | 86.8 | 55.2 | 0.2 | 20 | Comparative Example 1-1 |
| 1 | | 654.6 | 995.4 | 15.4 | 0.66 | 27.2 | 21.2 | 0.1 | 35 | Inventive Example 1 |
| 2-1 | 800 | 693.1 | 1000.6 | 13.7 | 0.69 | 92.3 | 65.3 | 0.3 | 20 | Comparative Example 2-1 |
| 2 | | 656.8 | 1005.1 | 14.6 | 0.65 | 28.2 | 13.5 | 0.1 | 40 | Inventive Example 2 |
| 3 | 800 | 651.1 | 1052.2 | 14.6 | 0.62 | 23.2 | 20.3 | 0 | 40 | Inventive Example 3 |
| 4-1 | 810 | 691.6 | 1079.9 | 10.9 | 0.64 | 107.4 | 63.5 | 0.4 | 25 | Comparative Example 4-1 |
| 4 | | 653.4 | 1029.6 | 13.1 | 0.63 | 34.3 | 25.3 | 0.1 | 40 | Inventive Example 4 |
| 5 | 790 | 641.9 | 1030.6 | 12.4 | 0.62 | 11.8 | 10.3 | 0 | 45 | Inventive Example 5 |
| 6 | 800 | 621.8 | 1023.6 | 12.1 | 0.61 | 24.8 | 15.6 | 0 | 35 | Inventive Example 6 |
| 7 | 800 | 654.6 | 1046.2 | 15.1 | 0.63 | 16.3 | 14.3 | 0.1 | 40 | Inventive Example 7 |
| 8 | 810 | 597.7 | 985.5 | 14.2 | 0.61 | 27.1 | 20.6 | 0 | 40 | Inventive Example 8 |
| 9-1 | 800 | 681.2 | 1008.3 | 14.0 | 0.68 | 77.9 | 51.2 | 0.1 | 20 | Comparative Example 9-1 |
| 9 | | 638.4 | 1024.5 | 16.4 | 0.62 | 23.8 | 15.3 | 0.4 | 35 | Inventive Example 9 |
| 10 | 800 | 699.1 | 1052.7 | 16.1 | 0.66 | 20.1 | 9.9 | 0.4 | 35 | Inventive Example 10 |
| 11-1 | 810 | 487.7 | 809.6 | 20.9 | 0.60 | 64 | 52.1 | 0.2 | 25 | Comparative Example 11-1 |
| 11 | | 473.3 | 835.0 | 20.8 | 0.57 | 27.3 | 20.2 | 0.3 | 40 | Inventive Example 11 |
| 12 | 800 | 502.0 | 803.0 | 19.2 | 0.63 | 25.4 | 15.5 | 0 | 45 | Inventive Example 12 |
| 13 | 800 | 503.3 | 808.9 | 20.4 | 0.62 | 26.8 | 10.1 | 0 | 50 | Inventive Example 13 |
| 14 | 800 | 494.4 | 791.7 | 21.5 | 0.62 | 16.8 | 9.6 | 0.2 | 50 | Inventive Example 14 |
| 15 | 800 | 504.9 | 821.7 | 19.3 | 0.61 | 34.1 | 22.5 | 0.1 | 45 | Inventive Example 15 |
| 16 | 800 | 454.9 | 812.2 | 19.6 | 0.56 | 33.9 | 10.2 | 0.1 | 40 | Inventive Example 16 |
| 17 | 800 | 792.0 | 1074.4 | 10.2 | 0.74 | 76.3 | 65.6 | 0.1 | 20 | Comparative Example 17 |
| 18 | 800 | 604.4 | 1087.1 | 15.1 | 0.56 | 35.1 | 22.1 | 0.5 | 20 | Comparative Example 18 |
| 19 | 800 | 892.1 | 1255.1 | 9.1 | 0.71 | 56.5 | 50.6 | 0.7 | 15 | Comparative Example 19 |
| 20 | 800 | 843.6 | 1109.5 | 11.3 | 0.76 | 15.4 | 12.5 | 1.5 | 20 | Comparative Example 20 |
| 21 | 800 | 574.3 | 922.7 | 15.2 | 0.62 | 51.2 | 34.1 | 0.6 | 35 | Comparative Example 21 |
| 22 | 750 | 485.6 | 802.3 | 11.6 | 0.61 | 96.5 | 52.1 | 1.5 | 15 | Comparative Example 22 |
| 23 | 890 | 702.3 | 843.6 | 10.1 | 0.83 | 65.1 | 42.1 | 2 | 20 | Comparative Example 23 |
| 24 | 800 | 412.5 | 793.5 | 22.3 | 0.52 | 29.5 | 15.5 | 2.5 | 25 | Comparative Example 24 |
| 25 | 800 | 465.6 | 809.6 | 17.1 | 0.58 | 55.6 | 50.1 | 0.8 | 25 | Comparative Example 25 |

In Table 4, SS may refer to a continuous annealing temperature, and ΔYS and ΔTS may refer to differences between YS and TS in the direction perpendicular to the rolling direction and in the rolling direction, respectively.

TABLE 5

| Steel No. | Ferrite Fraction (%) | Martensite Fraction (%) | Bainite Fraction (%) | Retained Austenite Fraction (%) | Mn Band Fraction (%) | Presence or Absence of Bare Spots | Note |
|---|---|---|---|---|---|---|---|
| 1-1 | 55 | 45 | 0 | 0 | 9 | X | Comparative Example 1-1 |
| 1 | | | | | 3 | X | Inventive Example 1 |
| 2-1 | 60 | 35 | 3 | 2 | 10 | X | Comparative Example 2-1 |
| 2 | | | | | 2 | X | Inventive Example 2 |
| 3 | 55 | 43 | 2 | 2 | 2 | X | Inventive Example 3 |
| 4-1 | 55 | 40 | 5 | 0 | 10 | X | Comparative Example 4-1 |
| 4 | | | | | 2 | X | Inventive Example 4 |
| 5 | 45 | 53 | 2 | 0 | 1 | X | Inventive Example 5 |
| 6 | 48 | 45 | 5 | 2 | 1 | X | Inventive Example 6 |
| 7 | 55 | 44 | 1 | 0 | 1 | X | Inventive Example 7 |
| 8 | 50 | 45 | 5 | 0 | 2 | X | Inventive Example 8 |
| 9-1 | 48 | 45 | 5 | 2 | 12 | X | Comparative Example 9-1 |
| 9 | | | | | 2 | X | Inventive Example 9 |
| 10 | 53 | 43 | 4 | 0 | 0 | X | Inventive Example 10 |
| 11-1 | 60 | 40 | 0 | 0 | 8 | X | Comparative Example 11-1 |
| 11 | | | | | 1 | X | Inventive Example 11 |
| 12 | 60 | 35 | 3 | 2 | 1 | X | Inventive Example 12 |
| 13 | 65 | 35 | 0 | 0 | 2 | X | Inventive Example 13 |
| 14 | 60 | 35 | 5 | 0 | 0 | X | Inventive Example 14 |
| 15 | 60 | 40 | 0 | 0 | 0 | X | Inventive Example 15 |
| 16 | 65 | 35 | 0 | 0 | 1 | X | Inventive Example 16 |
| 17 | 45 | 40 | 15 | 0 | 12 | X | Comparative Example 17 |
| 18 | 65 | 35 | 0 | 0 | 0 | 0 | Comparative Example 18 |
| 19 | 30 | 55 | 15 | 0 | 12 | X | Comparative Example 19 |
| 20 | 25 | 65 | 10 | 0 | 15 | X | Comparative Example 20 |
| 21 | 65 | 35 | 0 | 0 | 6 | X | Comparative Example 21 |
| 22 | 35 | 40 | 25 | 0 | 5 | X | Comparative Example 22 |
| 23 | 20 | 30 | 50 | 0 | 10 | X | Comparative Example 23 |
| 24 | 65 | 35 | 0 | 0 | 0 | 0 | Comparative Example 24 |
| 25 | 55 | 40 | 5 | 0 | 12 | X | Comparative Example 25 |

As illustrated in Tables 1-5, it could be seen that cold-rolled steel sheets [Inventive Examples 1-16 and 26-34] and hot-dipped galvanized/galvannealed steel sheets [Inventive Examples 1-16], having the composition in an exemplary embodiment in the present disclosure and manufactured using the manufacturing processes according to an exemplary embodiment in the present disclosure, satisfied a YR of 0.75 or less and an elongation of 13% or more (980 DP steel) or 18% or more (780 DP steel) as material properties illustrated in Tables 2 and 4. Further, a difference between strengths in the direction perpendicular to the rolling direction and in the rolling direction was 35 MPa or less in the case of YS, and 25 MPa or less in the case of TS, which satisfied the condition of 50 MPa or lower, proposed in an exemplary embodiment in the present disclosure. In addition, the results of measurements of bendability and HER satisfied the conditions of a bendability (R/t) of 0.5 or less and a HER of 30% or more, proposed in an exemplary embodiment in the present disclosure. Such material properties have a close relationship with the fraction of the Mn band within the martensite, in addition to controlling the fraction of transformation phases proposed in an exemplary embodiment in the present disclosure. That is, it could be seen that Inventive Examples 1-16 of the cold-rolled steel sheets and Inventive Examples 1-16 of the hot-dipped galvanized/galvannealed steel sheets, satisfying the composition and manufacturing method according to an exemplary embodiment in the present disclosure, as illustrated in Tables 3 and 5, had 3% or less of the fraction of the Mn band, based on 100% of the total fraction of the martensite, and thus satisfied the condition of 5% or less of the fraction of the Mn band, proposed in an exemplary embodiment in the present disclosure.

However, even though the composition satisfied the range of the present disclosure, all of Comparative Examples 1-1, 2-1, 4-1, 9-1, 11-1 and 34-1, steels not having been subjected to the soft reduction process at the time of the continuous casting process in the manufacturing process, exceeded 5% of the fraction of the Mn band.

FIGS. 4 and 5 illustrate images of microstructures of annealed steel sheets according to whether or not the annealed steel sheets are subjected to a soft reduction process at the time of continuously casting 980 MPa-grade steel and 780 MPa-grade steel. As illustrated in FIGS. 4 and 5, it could be seen that, when the annealed steel sheets were not subjected to the soft reduction process, a Mn band was present in a rolling direction, and such a Mn band caused a difference between material properties in a direction perpendicular to the rolling direction and in the rolling direction.

Meanwhile, Comparative Example 17 had a Si content lower than that in an exemplary embodiment in the present disclosure, had a somewhat low elongation due to a reduction in the content of Si, a ferrite formation element, and also had an increased fraction of the Mn band due to the low Si content. Accordingly, deviation of directional strength deviated from the condition of 50 MPa or less, proposed in an exemplary embodiment in the present disclosure.

Further, Comparative Examples 18 and 24 had a Si content more excessive than that in an exemplary embodiment in the present disclosure, and a Si/(Si+Mn) ratio did not also satisfy the condition proposed in an exemplary embodiment in the present disclosure. A largely added amount of Si may increase the fraction of ferrite of the annealed steel sheets to increase ductility. However, an excessively added amount of Si may increase a difference between strengths of the ferrite and a transformation phase to degrade bendability and HER, and may cause bare spots on the hot-dipped galvanized/galvannealed steel sheets. Further, as illustrated in FIG. 3, when the Si/(Si+Mn) ratio exceeds 0.5, the internal oxidation of the hot rolled steel sheets may increase.

Comparative Examples 19, 20, and 24 had C, Mn or Cr, and Mo contents that exceeded those in an exemplary embodiment in the present disclosure. Such elements may strengthen steel, and may function to increase the fraction of transformation phases included in the annealed steel sheets. Even though the soft reduction process was performed on the annealed steel sheets at the time of the continuous casting process, excessively added amounts of alloying elements made the removal of the Mn band impossible, and the content of the Mn band included in the annealed steel sheets did not satisfy the condition of 5% or less, proposed in an exemplary embodiment in the present disclosure.

In addition, Comparative Examples 22 and 23 had a composition that satisfied the range of the present disclosure, but had an excessively high or low annealing temperature. Comparative Example 22, having a very low annealing temperature, was recrystallized insufficiently to degrade ductility, and had great deviation of directional material. In contrast, Comparative Example 23, having a very high annealing temperature of 890° C., had an increased fraction of bainite when being cooled due to a reduction in C content caused by an excessive amount of austenite generated at the time of an annealing process, and thus did not satisfy the condition of 10% or less, proposed in an exemplary embodiment in the present disclosure. Accordingly, YS and a yield ratio of Comparative Example 23 were also increased.

While exemplary embodiments have been shown and described above, it will be apparent to those skilled in the art that modifications and variations could be made without departing from the scope of the present invention as defined by the appended claims.

The invention claimed is:

1. A method for manufacturing a hot-dipped galvanized steel sheet with low deviation of directional material and excellent formability, the method comprising:

manufacturing a steel slab using soft reduction and heating the steel slab at the time of continuously casting steel using molten steel, the molten steel including, by wt %, 0.05 to 0.15% of C, 0.2 to 1.5% of Si, 2.2 to 3.0% of Mn, 0.001 to 0.10% of P, 0.010% or less of S, 0.01 to 0.10% of sol.Al, 0.010% or less of N, and the balance of Fe and impurities, satisfying a condition of Si/(Mn+Si)≤0.5;

finish hot rolling the heating steel slab at a temperature range of Ar3 to Ar3+50° C., and coiling the hot-rolled steel sheet at a temperature range of 600 to 750° C.;

cold rolling the coiled steel sheet at a cold reduction ratio of 40 to 70%, and then continuously annealing the cold-rolled steel sheet at a temperature range of Ac1+30° C. to Ac3−30° C.; and primarily cooling the continuously annealed steel sheet to a temperature range of 650 to 700° C., and then secondarily cooling the primarily cooled steel sheet to a temperature range of 600° C. or lower at an average cooling rate of 3 to 30° C./s; and annealing the cooled steel sheet, and then galvanizing the annealed steel sheet, wherein the hot-dipped galvanized steel sheet has a microstructure consisting of, by area %, 40 to 67% of ferrite, 10% or less of bainite, 1 to 3% of retained austenite, and a sum of the fraction of the ferrite and martensite is 90% or more, and the fraction of a Mn band present within the martensite is 5 area % or less, and wherein a yield strength of the hot-dipped galvanized steel sheet is 601.8 to 699.1 MPa.

2. The method of claim 1, wherein the hot-dipped galvanized steel sheet has TS(tr.)−TS(lo.) and YS(tr.)−YS(lo.) of 50 MPa or lower, respectively, where tr refers to a direction perpendicular to a rolling direction and lo refers to the rolling direction.

3. The method of claim 1, wherein the hot-dipped galvanized steel sheet further comprises at least one of Ti or Nb in an amount of 0.05% or less.

4. The method of claim 1, wherein the hot-dipped galvanized steel sheet further comprises at least one of 0.1 to 0.7% of Cr or 0.1% or less of Mo.

5. The method of claim 1, wherein the hot-dipped galvanized steel sheet further comprises 0.0060% or less of B.

6. The method of claim 1, wherein the hot-dipped galvanized steel sheet further comprises 0.5% or less of Sb.

7. A method for manufacturing a hot-dipped galvannealed steel sheet with low deviation of directional material and excellent formability, the method further comprising galvannealing the hot-dipped galvanized steel sheet at a temperature range of 450 to 600° C., after the manufacturing of the hot-dipped galvanized steel sheet according to claim 1.

* * * * *